Fig_2
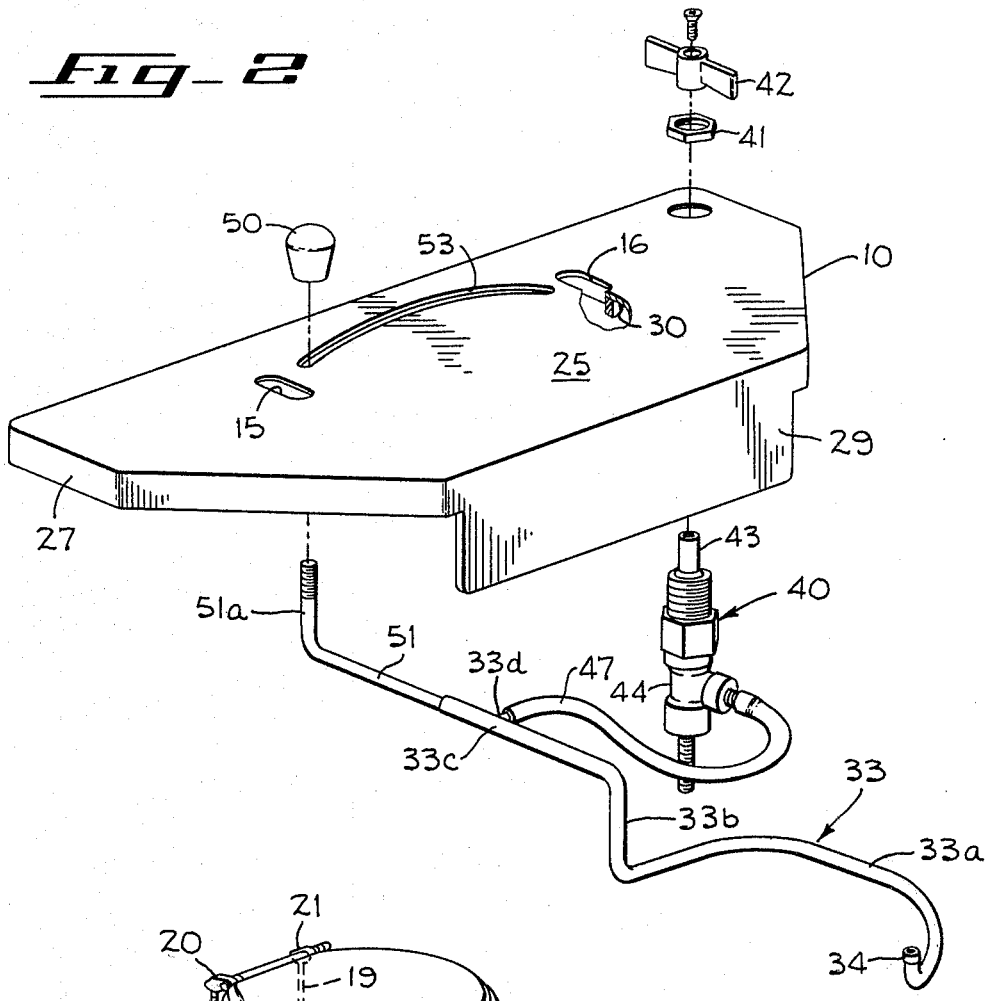
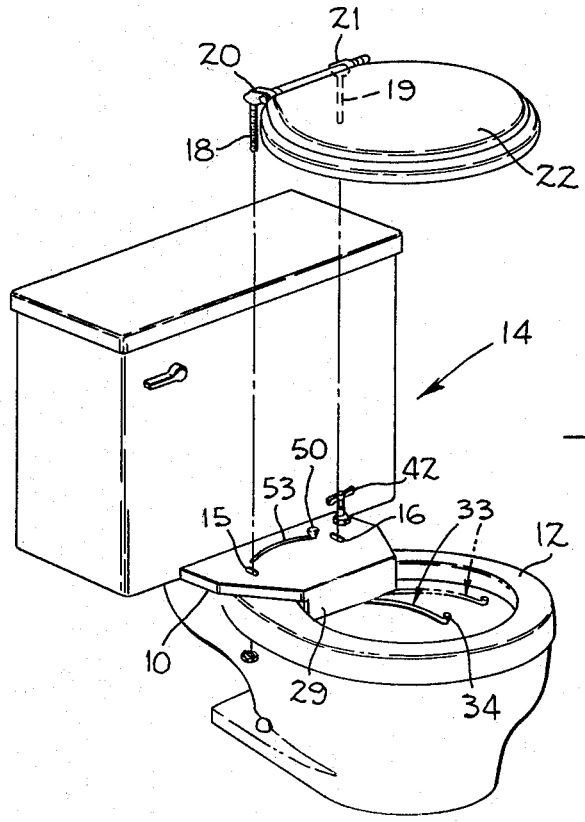
Fig_1

Fig_3
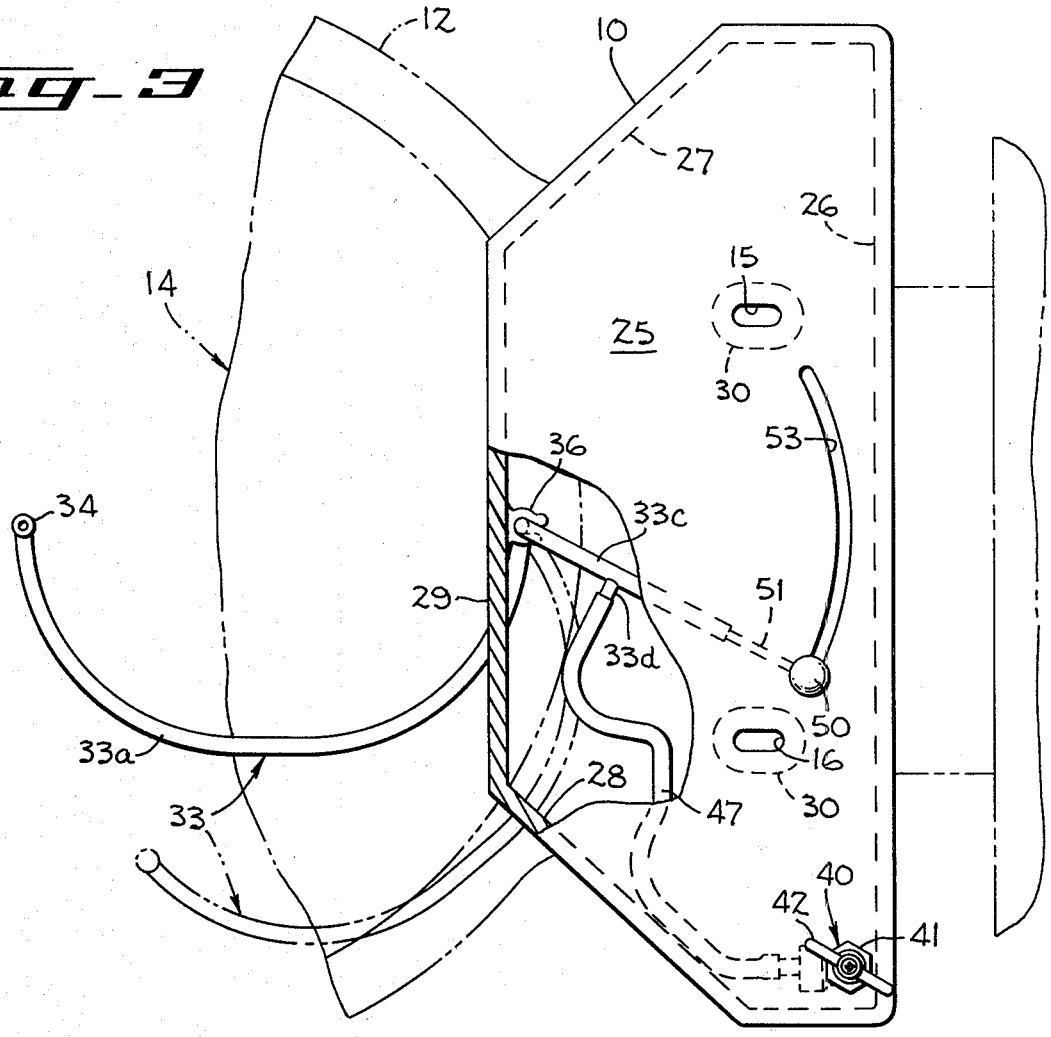
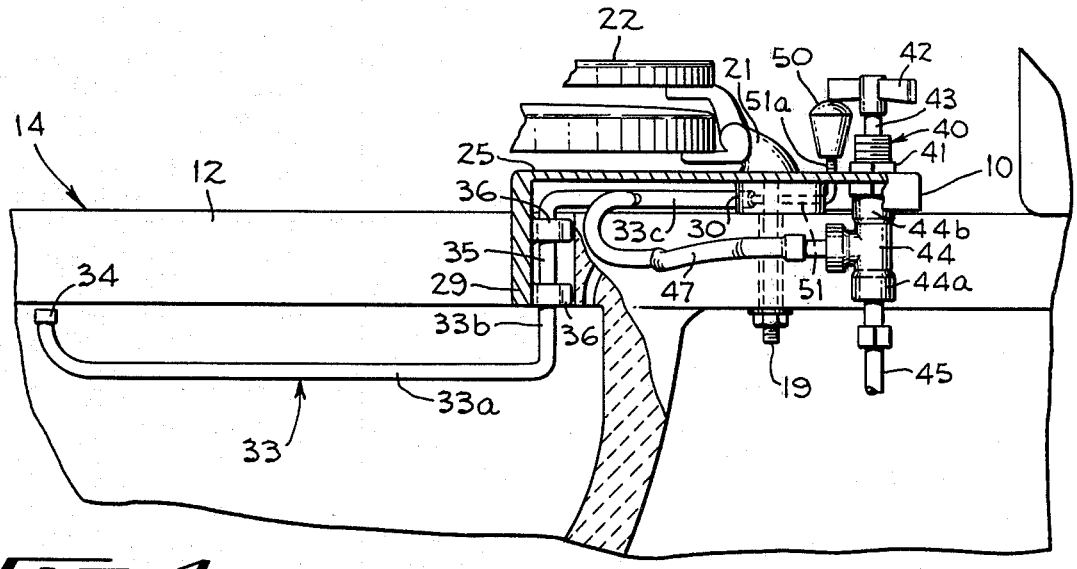
Fig_4

ATTACHMENT FOR A WATER CLOSET

BACKGROUND OF THE INVENTION

1. Field of the Invention

This invention relates to sanitary appliances and more particularly concerns an attachment for a conventional toilet bowl to provide to the user of the toilet the functional cleansing operations of a bidet.

2. Description of the Prior Art

Bidet attachments, that have been provided for use in association with toilets, require a special seat construction, as in the devices shown in patents to Pazos U.S. Pat. No. 2,774,078 and Guidetti U.S. Pat. No. 1,962,014, or make use of a bracket that is adapted to be fastened to the underside of the seat, as in Guidetti et al. U.S. Pat. No. 1,949,415 and Parisini U.S. Pat. No. 2,104,271. The patent to Popil U.S. Pat. No. 2,344,561 discloses the use of a C-clamp mechanism which is adapted to be locked on the rim of the bowl. Of the above-mentioned devices, only that of Popil can be used with a conventional toilet seat without permanent damage or alteration of the seat.

Several of the attachments disclosed in these patents disclose arrangements for moving a water-supply pipe from an inoperative position near the side or rear edge of the rim of the toilet bowl to an operative position near the center of the bowl including the use of flexible conduit to facilitate the swinging movement of the pipe. The patents to Heald U.S. Pat. No. 2.094,170 and Guidetti U.S. Pat. No. 1,966,951 also disclose such devices.

SUMMARY OF THE INVENTION

A flat, stainless steel attachment plate is adapted to be secured in position between the seat and the upper rear portion of the rim of a conventional toilet bowl by the bolts which normally mount the toilet seat on the rear edge of the toilet bowl. The plate has bosses extending downwardly from its lower surface which have flat, planar surfaces for evenly engaging upwardly facing portions of the bowl to stabilize the plate on the bowl, and a downwardly extending front wall that is arranged to extend down into the rear portion of the bowl and engage the bowl rim to position the attachment plate relative to the bowl. The handle of a valve is mounted in upwardly-extending position at one rear corner of the plate in a convenient position for operation by the user to control flow of water to a conduit that carries a spray nozzle and is pivotally carried on the undersurface of the attachment plate. An actuating knob, which is also carried by the plate to project upwardly therefrom for actuation by the user, is operatively connected to the water conduit through a slot in the plate.

It is an object of the present invention to provide an attachment for a conventional water closet that can be conveniently installed and removed without causing permanent damage or alteration to the bowl or the seat and one that is equipped with all of the necessary operating mechanisms including a flow control valve and a nozzle-positioning control knob.

Another object is to provide a bidet attachment that has means for mounting the attachment in a stable position on a toilet bowl.

DESCRIPTION OF THE DRAWINGS

FIG. 4 is a side elevation of the apparatus of FIG. 3 with parts broken away and parts in section.

DESCRIPTION OF A PREFERRED EMBODIMENT

Figure 1:
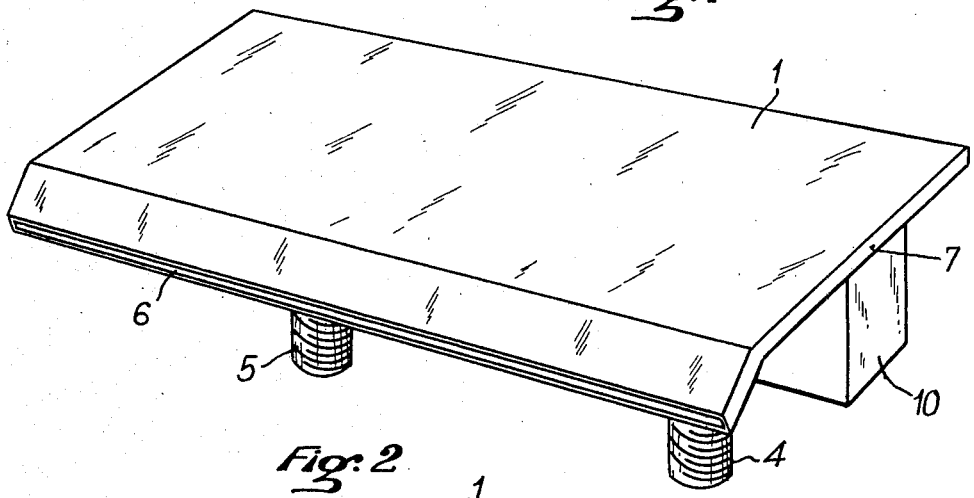
FIG. 1 is an exploded perspective showing the attachment of the present invention in position on the bowl of a conventional water closet.
Figure 2:
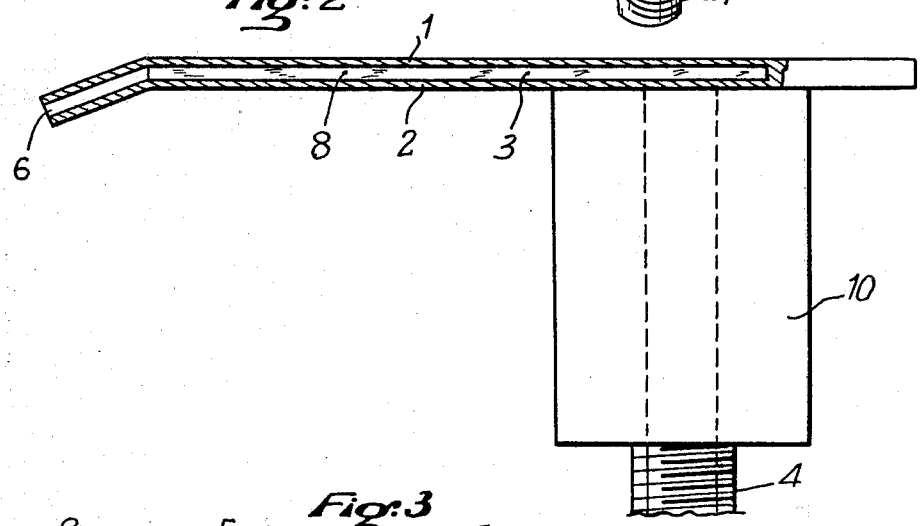
FIG. 2 is an exploded isometric view of the attachment of FIG. 1.

The attachment 10 (FIG. 1) of the present invention is adapted to be secured to the upper rear surface of a toilet bowl 12 of a conventional water closet unit 14. The attachment is a flat plate member that is provided with two holes 15 and 16 which are located to receive the bolts 18 and 19 carried by and projecting downwardly from two mounting members 20 and 21, respectively, on which the toilet seat 22 is pivotally mounted. It will be evident that, when installed on the toilet bowl, the attachment 10 will be locked between the upper surface of the rim and the rear portion of the toilet seat.

Figure 3:
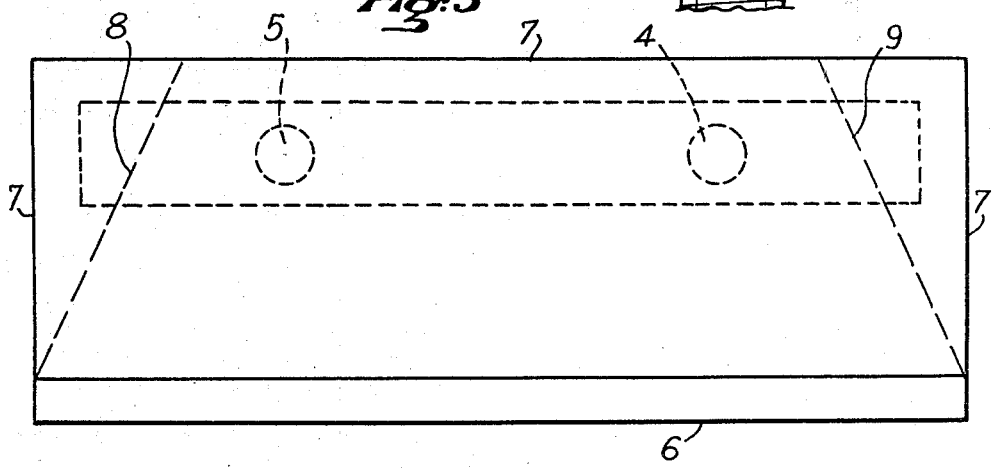
FIG. 3 is a plan view of the attachment.

As seen in FIG. 3, the attachment 10 has a flat central body 25 with a rear wall 26 and two side walls 27 and 28 and integrally formed therewith and extending downwardly about one-half inch. A front wall 29, which extends downwardly about one and one-half inches, has a transverse dimension adapting it to fit inside the rim of the bowl as seen in FIGS. 1 and 4 and engage the curved rear wall to act as a positioning member. Two tubular bosses 30 (FIG. 4) are integrally formed with the plate and extends downwardly from the underside of the plate in alignment with the holes 15 and 16. When locked in place by the bolts 18 and 19 which extends through the bosses 30, the attachment which is made of plastic, rests on the flat rear surface of the toilet bowl with the flat lower surfaces of the bosses in stabilizing contact therewith. A water inlet conduit 33 (FIG. 4) which is a rigid copper tube, has an upturned end on which a nozzle 34 is secured. The conduit, which has a curved central portion **33*a* (FIG. 3) that is disposed in a generally horizontal attitude when the attachment is installed on a toilet bowl, is integrally formed with an upright conduit section 33*b* (FIG. 4) which snaps into two sockets 36 that are integrally formed with the rear wall 29 of the attachment. A horizontal section 33*c* of the conduit extends rearwardly from the upright section and is provided with a tubular copper branch 33*d* (FIG. 3) which is somewhat reduced in diameter and extends at right angles to section 33*c***.

A valve 40 is locked on one rear corner of the attachment plate by a nut 41. A handle 42 is connected to a rotatable valve stem 43 that is in threaded engagement with an internally threaded portion of branch **44*b* of a valve 44 and carries a tapered plug valve element (not shown) at its inner end. The valve element is adapted to seat in a mating seat in the branch 44*a* of the valve body 44. When the valve element is in an open position removed from its seat, flow communication is established between a water supply line 45 and a flexible conduit 47 that is connected to the branch conduit 33*d*, as seen in FIG. 3. The conduit 47** may be made of a natural or synthetic rubber of a suitable plastic.

The nozzle 34 is moved from the projected position centrally of the bowl to the retracted position, shown in phantom lines in FIG. 3, by actuation of a knob 50 that is threaded on an upwardly projecting end portion 51*a* of a rod 51. The rod 51 extends into the end of conduit section 33*c* and is soldered therein to close the end of the conduit and secure the rod 51 to the conduit so that actuation of the knob will cause controlled pivoting of the conduit in the bushing 35. The upwardly projecting portion 51*a* travels in a slot 53 in the flat body 25 of the attachment, the slot being formed on an arc of a circle about the center of the pivot holes of sockets 36.

A feature of the present invention in the provision of the flexible conduit 47 for connecting the fixed water supply line to the movable conduit section 33*c*, and it is to be noted in FIG. 3 that, when the conduit section 32*c* is in the nozzle-projecting position, several bends and curved sections are formed in the conduit 47. Accordingly, when the nozzle is moved to the retracted position and the conduit section 33*c* swings away from the valve 40, the bends and curved sections of the flexible conduit 47 tend to straighten out and permit this movement.

Another feature of the attachment of the present invention is the stable mounting of the attachment on the bowl that is provided by the lower surfaces of the bosses 30. These surfaces are in a common plane and are pressed into firm even engagement with the upper surface of the bowl when the nuts are screwed up tightly on the bolts 18 and 19.

The water supply lines 45 is connected to the valve 44 (FIG. 4) in a conventional manner, as by a nipple and a union, and the supply line may receive a mixture of hot and cold water from a T-fitting, one opening of which receives a conduit leading to a source of hot water and the other opening receiving a conduit leading to a source of cold water. Each of the two conduits is, of course, provided with a conventional valve by which the proportion of hot and cold water entering the T-fitting can be varied to obtain a mixture at the desired temperature.

The attachment of the present invention is installed as described above by bolting it to the rear of the toilet bowl and making a suitable connection by means of a union or the like with a source of water of hot and cold water. The hot and cold water valves are then adjusted to obtain the desired temperature for the mixture that is discharged by the nozzle when the knob 50 is actuated to move the spray nozzle to a centered position and the valve 44 is opened.

From the foregoing description it will be apparent that the present invention provides an effective bidet attachment that can be easily installed on a conventional water closet without permanent damage to any of the parts of the water closet, and one that carries all the control elements which are necessary for the successful use of such an attachment.

I claim:

1. In a water closet having a bowl with an annular upper surface, a toilet seat, and means detachably securing said seat to the upper surface of said bowl at the rear thereof, a bidet attachment therefor comprising:

a mounting plate having a substantially planar upper portion for engagement with the underside of said seat, and having depending side flanges for engaging the upper surface of the bowl to space said upper portion theefrom and a depending transverse forward flange therebetween to extend within the bowl, means on said plate for cooperative association with said seat and bowl securing means for fixing said plate between said seat and bowl, a spray conduit pivotally mounted to said plate, said conduit including a nozzle portion extending forwardly therefrom beneath said forward flange and a control lever portion extending rearwardly beneath said mounting plate upper portion for manual engagement, whereby movement of said control portion of said spray conduit swings said forward nozzle portion relative to said plate for appropriate positioning with respect to said bowl and seat, and, a valve-controlled water supply line connected to said conduit, whereby said attachment provides a bidet for a water closet without alteration of said bowl or seat thereof.

2. The bidet attachment of claim 1 wherein said spray nozzle control lever portion includes an upwardly extending handle, and said mounting plate is provided with an arcuate slot through which said handle extends wherein said slot permits said swinging of said nozzle to position the same.

3. The bidet attachment of claims 1 or 2 wherein a valve for said water supply line is attached to said plate and extends upwardly therefrom and wherein further said water supply line includes a flexible portion between said valve and said spray conduit.

4. The bidet attachment of claim 3 wherein said spray conduit includes a mounting portion disposed between said nozzle portion and said control level portion, said mounting portion being pivotally secured to said depending transverse flange.

5. The bidet attachment of claim 4 further including depending bosses on said mounting plate upper portion in cooperative association with said bowl and seat securing means.

* * * * *